US007196674B2

(12) United States Patent
Timofeev et al.

(10) Patent No.: US 7,196,674 B2
(45) Date of Patent: Mar. 27, 2007

(54) DUAL POLARIZED THREE-SECTOR BASE STATION ANTENNA WITH VARIABLE BEAM TILT

(75) Inventors: Igor Timofeev, Dallas, TX (US); Xiangyang Ai, Irving, TX (US); Anthony Teillet, Flower Mound, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/718,919

(22) Filed: Nov. 21, 2003

(65) Prior Publication Data

US 2005/0110699 A1 May 26, 2005

(51) Int. Cl.
*H01Q 21/00* (2006.01)

(52) U.S. Cl. ..... 343/810; 343/700 MS; 343/829

(58) Field of Classification Search ..... 343/810, 343/700 MS, 793–795, 797, 821, 853, 860, 343/893, 906
See application file for complete search history.

(56) References Cited

U.S. PATENT DOCUMENTS 3,761,937 A * 9/1973 Tricoles et al. ..... 343/770
6,133,889 A * 10/2000 Yarsunas et al. ..... 343/792.5
6,140,974 A * 10/2000 Dalley ..... 343/806
6,295,028 B1 * 9/2001 Jonsson et al. ..... 343/700 MS
6,621,465 B2 * 9/2003 Teillet et al. ..... 343/797
6,697,029 B2 * 2/2004 Teillet et al. ..... 343/797
6,885,352 B2 * 4/2005 Lee et al. ..... 343/836
2005/0001778 A1 * 1/2005 Le et al. ..... 343/810
2005/0253769 A1 * 11/2005 Timofeev et al. ..... 343/797

FOREIGN PATENT DOCUMENTS

WO 97/06576 * 2/1997
WO WO 97/06576 2/1997

* cited by examiner

*Primary Examiner*—Trinh Vo Dinh
(74) *Attorney, Agent, or Firm*—Jackson Walker LLP; Robert C. Klinger

(57) ABSTRACT

A dual polarized three-sector base station antenna with variable beam tilt in each sector. The invention advantageously provides a variable phase shifter with very small lateral dimensions which significantly reduces the diameter of a three-sector antenna. The feed network is located on both sides of the antenna ground plane, and the combination of the cable, microstrip and airstrip lines further reduces the lateral size of the antenna. Metal rings on the radome and double-bended ground plane are providing antenna with better cross-polarization and port-to-port isolation.

27 Claims, 10 Drawing Sheets

DUAL POLARIZED THREE-SECTOR BASE STATION ANTENNA WITH VARIABLE BEAM TILT

FIELD OF THE INVENTION

The present invention is related to the field of antennas, and more particularly to dual polarized base station antennas for wireless communication systems.

BACKGROUND OF THE INVENTION

In wireless (cellular) communications, an uplink signal at a base station antenna usually fluctuates as a result of fading caused by multiple reflections at buildings and obstacles. To reduce this fading effect, prior art base stations may have an additional antenna for the same sector to provide space diversity. This type of antenna system, however, is bulky and is generally considered to be aesthetically unpleasing. Another known way to reduce fading is through polarization diversity, i.e. reception of signals on two orthogonal polarizations (usually slant polarizations of +/−45°). Polarization diversity allows a decrease in the number of antennas by two times in comparison with space diversity. However, the base station still needs at least three antennas for a three-sector operation. In an urban environment, polarization diversity provides signal quality similar to space diversity. At the same time, in urban areas, the visual impact of a base station antenna has become a big concern, especially in historical or fine art architecture districts.

As is well known in the art, three polarization diversity antenna arrays can be combined in one cylindrical radome to decrease their visual impact and reduce the number of antennas for a base station to just one. Each vertical array for a 120° sector is constructed using slant 45° crossed dipoles located above a ground plane. If the diameter of this three-sector antenna is small enough, it can be used as part of a light pole, flagpole, or even as an element of church cross, so that the antenna can be invisible in the environment. Hence, it is very important to decrease the diameter of the antenna. At the same time, it is very important for an antenna to have good mechanical strength such that it can be used as an element of some structures.

Notably, prior-art three-sector antennas do not find wide field of application. One reason is their large diameters, as was discussed above. Another main reason is the need for the sector optimization.

One main method to optimize the coverage area of an antenna beam is tilting the beam downward (mechanically or electrically) from the horizontal axis in the vertical plane. More down tilt achieves a smaller cell size. In the case of a three-sector antenna, each of the 3 antenna arrays often need to have different beam tilts to suppress the interference with adjoining cells, and to provide the cell size optimization because conditions are usually quite different in different directions. Conventionally, mechanical down tilt does not work well for a three-sector antenna. To make a three-sector antenna more universal, it needs to have electrical variable down tilt for each of three sectors.

To provide a variable down tilt, an antenna may have adjustable phase shifters incorporated with its feed lines. A one-sector antenna variable phase shifter may consist of a dielectric block on a meander line moving orthogonal to its axis. This type of phase shifter has significant lateral dimensions, and cannot be used in a three-sector array without increasing of it's diameter.

Another big issue for every base station antenna is intermodulation (IM). The main method to minimize IM is to avoid metal-to-metal contacts.

Another problem with prior dual polarized dipole arrays with variable tilt is beam squint in the horizontal plane (up to 12° with 10° tilt).

As well known in the art, the mutual coupling between crossed dipoles influences correlation of the two orthogonal polarized signals, and can disturb the effect of polarization diversity. When three antennas are combined together, the effect of mutual coupling becomes even worse. To provide polarization diversity, dual polarized base station antennas have to meet a certain port-to-port isolation specification (typically more than 30 dB), and a certain level of cross-polarization (the co-pol to cross-pol ratio must be more than 10 dB in all 120° sectors).

Another challenge with three-sector antennas is back radiation. Back radiation is characterized by front-to-back (F/B) ratio, which usually needs to be more than 25 dB. Wider antenna ground plane gives better F/B. With narrower ground plane F/B can degrade.

It is one principal object of the present invention to provide a dual polarized antenna array with a compact package.

It is a further object of the invention to provide a dual polarized antenna array with a variable beam tilt.

It is another object of the invention to provide an antenna capable to meet at least 30 dB port-to-port isolation.

It is another object of the invention to provide an antenna array capable to meet at least a 10 dB co-pol to cross-pol ratio in a 120 degree horizontal sector.

It is another object of the invention to provide an antenna array having a 65–85° horizontal beamwidth.

It is another object of the invention to provide an antenna array with a front-to-back ratio of more than 25 dB.

It is a further object of the invention to provide a dual polarized antenna with a high gain.

It is further object of the invention to provide a dual polarized three-sector antenna having a variable beam tilt with small (less the wavelength) diameter of radome.

It is another object of the invention to provide an antenna array with minimized intermodulation.

It is further object of the invention to provide a inexpensive antenna.

SUMMARY OF THE INVENTION

The present invention advantageously provides a compact dual polarized three-sector base station antenna with variable beam tilt in each sector, allowing wireless operators much more flexibility and opportunity to use such an antenna where conventional antennas cannot be used.

The present invention advantageously provides a variable phase shifter with very small lateral dimensions, which significantly reduces the diameter of a three-sector antenna. The feed network is located on both sides of the antenna ground plane, and the combination of the cable, microstrip and airstrip lines further reduces the lateral size of the antenna. This design also helps to eliminate parasitic coupling between feed lines, which is especially important for dual polarized antennas with higher gain and a significant number of elements.

The present invention advantageously provides a low IM level because two balun hooks and a divider for the dipoles' pair are made from one piece of metal. In addition, the transition between the airstrip and microstrip lines has the common ground plane. Moreover, special spacers are used between the three arrays to minimize contact area between them.

The present invention advantageously allows to minimize beam squint of dipole array by location of the balun hooks symmetrically with respect to vertical axis of the array.

The present invention reduces mutual coupling and improves port-to-port isolation and cross-polarization by using metal rings and strips on a cylindrical antenna radome.

The present invention achieves F/B>25 dB, and further improves a cross-polarization level with narrow (less than λ) ground plane having dual bending edges. These bent edges means also increase the structural strength of antenna.

The present invention further provides-a means to create a dual polarized three-sector base station antenna with variable beams' tilt with minimization of its diameter and optimization of cross-polarization, port-to-port isolation, beam squint, IM, front-to-back ratio and mechanical strength.

The improved antenna array for transmitting and receiving electromagnetic waves has +45° and −45° linear polarizations comprising a ground plane, a plurality of dipole radiating elements along a vertical axis of the ground plane on it's outward side, and a printed circuit board attached to the backside of the board. The ground plane is double bended on both sides and symmetrical to the vertical axis. The bended edges look outwardly from the ground plane. The first bend angle is 30°, and the second bend angle is 140–170° with respect to the ground plane.

Each of radiating elements includes two orthogonal dipoles aligned at an angle of +45° and −45° with respect to vertical axis, and two airstrip balun hooks, bonded to each dipole symmetrically with respect to vertical axis. By means of a 1:2 airstrip divider, two radiating elements are combined in pairs. The two balun hooks and the divider are made from one piece of metal, forming an airstrip attached to a tray and the dipoles by dielectric rivets and spacers. The airstrip has a 90° bend at the midsection in the form of a beak. Each beak extends through holes in the ground plane and printed circuit board to microstrip lines on the printed circuit board. The microstrip lines form two feed networks connected to +45° and −45° antenna ports through RF cables. The two feed network have meander line sections with an axis parallel to the vertical axis of ground plane. The antenna array can also include dielectric blocks moving along each feed network parallel to vertical axis to provide variable phase between pairs of elements. Dielectric blocks are attached to two rods, connected to the handle. Teflon tape is disposed between the microstrip line and the dielectric blocks to reduce friction. Three of the arrays are attached to each other to form the three-sector antenna. Dielectric or metal spacers are used between the adjacent ground planes of the three arrays to minimize contact surface between them and to improve intermodulation.

The three-sector antenna can also include a cylindrical radome. On the outward surface of the radome metal pattern are rings, strips or crosses can be placed to re-radiate electromagnetic fields and to improve the antenna pattern and port-to-port isolation.

DETAILED DESCRIPTION OF THE PREFERRED EMBODIMENT

One embodiment of the present invention operates in a Personal Communication System (PCS) in a frequency band 1850–1990 MHz, but which invention is applicable to others frequency bands as well.

Figure 1:
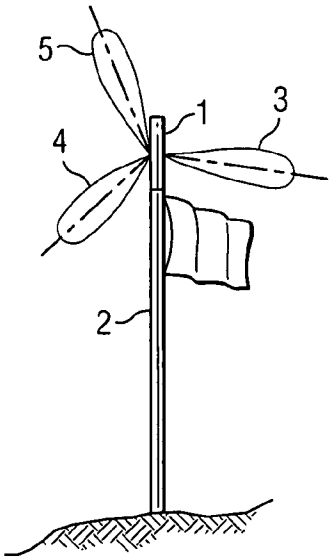
FIG. 1 is a schematic representation of a three-sector antenna mount configured as part of a flagpole.

FIG. 1 shows a three-sector base station antenna 1 according to the present invention mounted on a flagpole 2 to make it virtually invisible in the environment. FIG. 1 also illustrates the need and provision of different down tilts for each of beam 3, beam 4, and beam 5, in this case, because the terrain is not flat.

Figure 2:
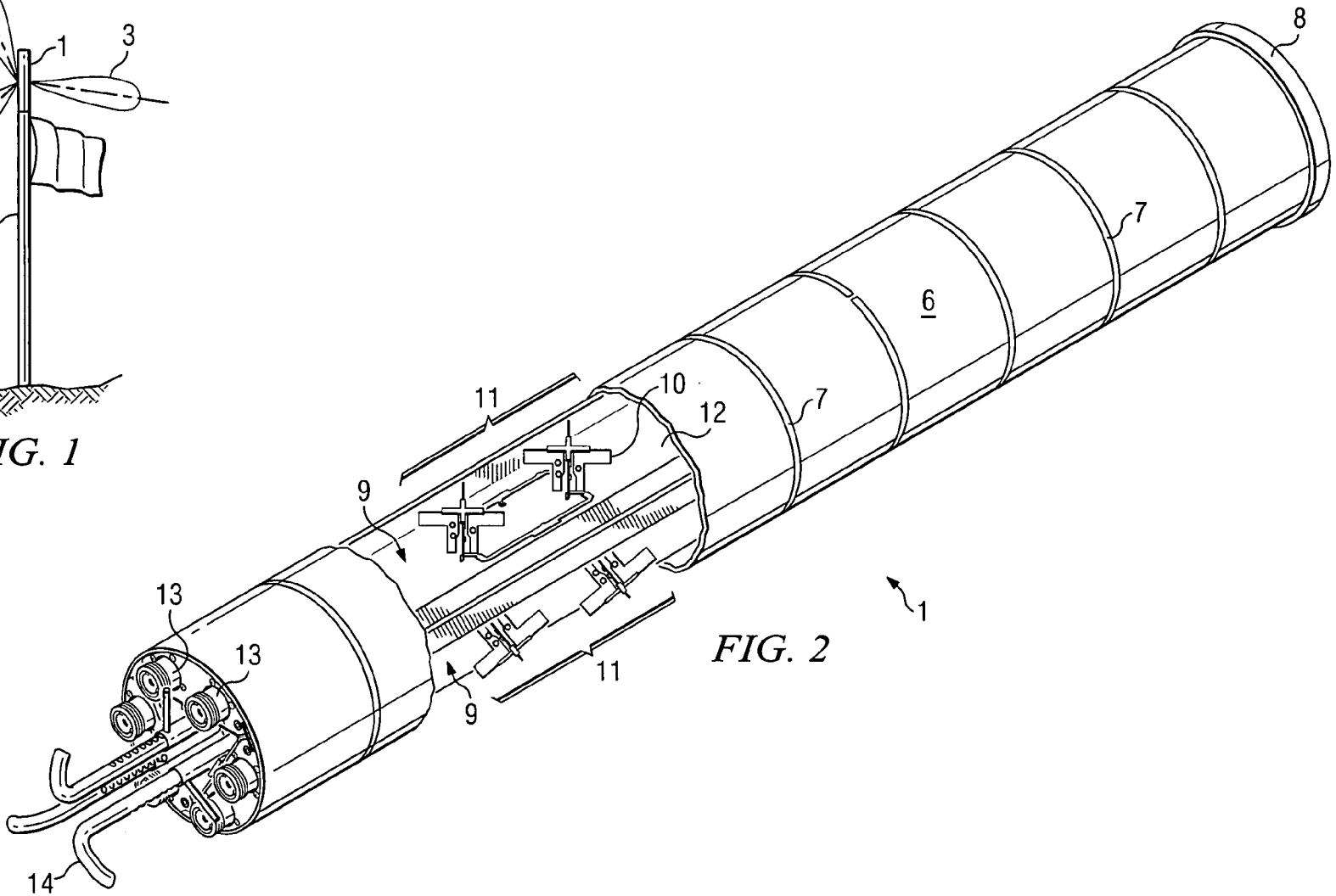
FIG. 2 is a perspective cut-away view of the three-sector antenna with a side portion of the cylindrical radome cut away.
Figure 3:
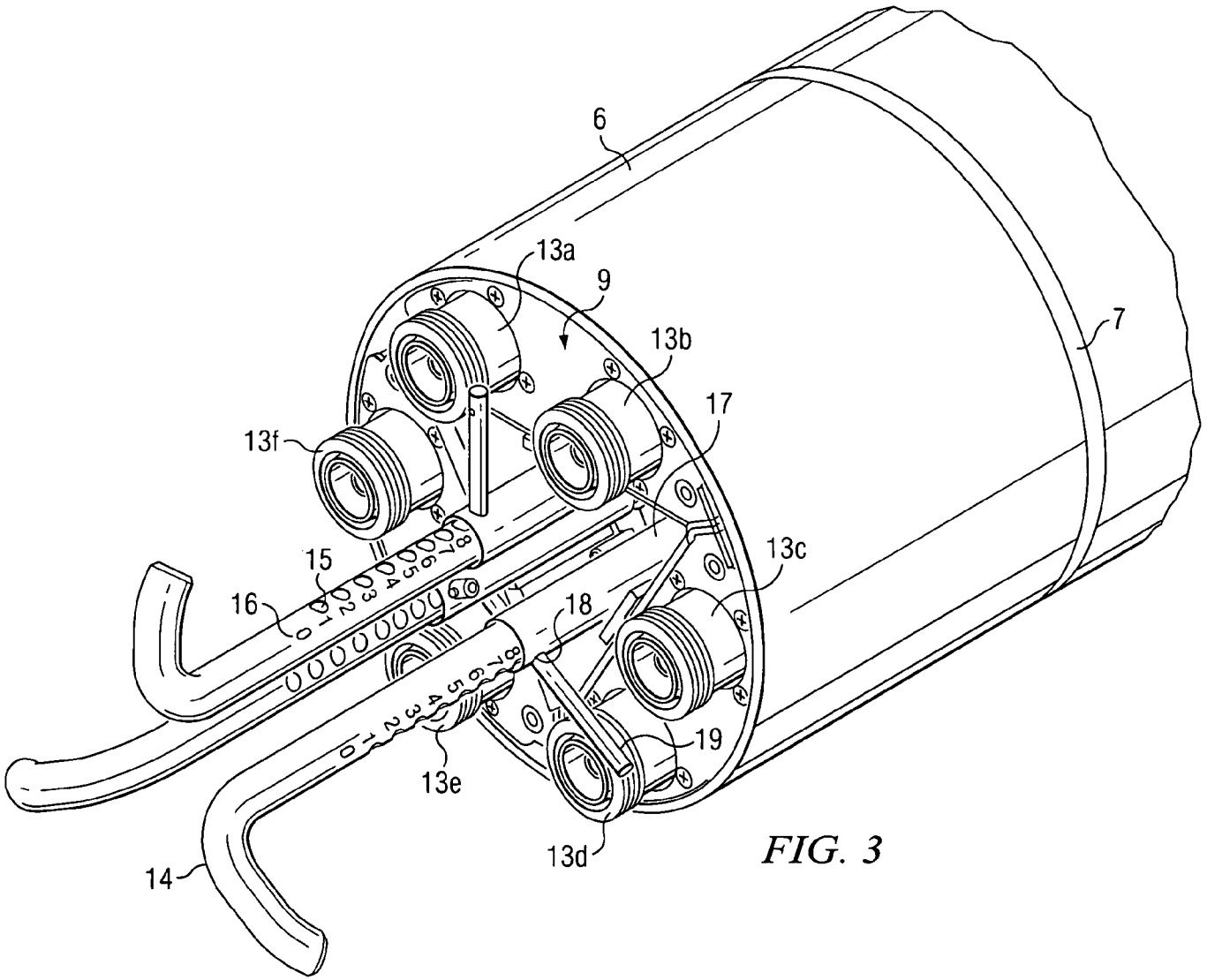
FIG. 3 is a perspective view of the bottom area of the antenna of FIG. 2 in increased scale.

FIG. 2, 3 illustrate the dual polarized (±45°) three-sector base station antenna 1 with variable sector beam tilts 1 suitable for use in the application shown in FIG. 1 or other similar applications. The antenna 1 is enclosed by a cylindrically shaped radome 6 formed of dielectric material. Metal strips 7 on the radome 6 provide antenna 1 with better port-to-port isolation than without the strips. End cup 8 seals the top of radome 6. Inside the radome 6 are three identical antenna arrays 9 combined together in one structure, as shown in FIG. 2, 3. Every antenna array 9 has several pairs of crossed dipoles 10 combined in pairs 11 located on a ground plane 12. Two RF connectors 13 (one for a −45° port and another for a +45° port) are attached to the bottom area of the ground plane 12. By moving a handle 14, the beam tilt of the respective array 9 is changed for both the +45° and the −45° ports. Each handle 14 has a half −U shape for convenience, and it is positioned between connectors 13 to provide easy access to it when outside cables (not shown) are connected to connectors 13. Each handle 14 has holes 15 with numbers 16 indicating associated beam tilt (usually with 10 increments). Each pipe 17 is supported by the respective ground plane 12, and is also used for longitudinal guidance of respective handle 14. Respective pin 19 fixes respective handle 14 (and, respectively, the antenna beam) in a desirable position. To change the beam tilt, one needs to remove pin 19 from the holes 15 and 18, shift handle 14 to a new position, and drive pin 19 in the holes 15, 18. The present invention is a convenient and low cost method providing adjustable beam tilt.

Each beam 3, 4, and 5 can be individually and separately pre-set before installation of antenna 1, or adjusted in the field. In the field, the cylindrical cover (not shown) closes parts 13 to 19, and the antenna 1 appears as pure cylinder (see FIG. 1). A mounting base for the antenna 1 is not shown.

To understand the phase shifter/feed network of one antenna array 9, reference is made to FIG. 4–6*a* where the different views of antenna array 9 are shown. To provide a compact and low cost design, a feed network is provided on both sides of the ground plane 12 and combined with cable, microstrip and airstrip lines. A cable 20 is connected to each connector 13 on its one end, and to a microstrip line 21 on another end. The location of each cable 20 on the outward side of the ground plane 12 provides more space for phase shifters, located on inward side thereof. Microstrip lines 21 are printed on each printed circuit board 22 and have T-dividers 23 and meander sections 24 (see FIG. 6, 6*a*). The meander microstrip sections 24 are connected through solder joints 25 to the opposing radiating dipole pair 11. On the top of the meander section 24 there are movable dielectric blocks 26 attached to rods 27. Two rods 27*a*, 27*b* are mechanically connected through plate 28 to the respective handle 14. Bridges 29 provide guidance to rods 27. Teflon tape can be used between dielectric blocks 26 and meander sections 24 to reduce friction between them. By moving handle 12, and respectively dielectric blocks 26, the phase velocity of the microstrip line is correspondingly changed, and the phase velocity amount is a function of how much the meander section 24 is covered by the respective dielectric blocks 26. Thus, the selective location of the dielectric block 26 correspondingly changes the phase difference $\Delta\phi$ between respective radiating pairs 11. The beam tilt $\theta$ can be found from the equation:

$$\Delta\phi=(4\pi d \sin\theta)/\lambda$$

where d is distance between dipoles 10, and $\lambda$ is the wavelength. By moving handle 12, one can change the beam tilt of the corresponding antenna array 9 in synchronism for both +45° and −45 ports. Meander sections 24, together with high dielectric constant ($\epsilon$=6–20) provides a reduced traveling of handle 12 for a desired phase velocity shift, and makes antenna array 9 more compact. Another advantage of this phase shifter/feed network is its small lateral dimensions, due to dielectric blocks 23 and meander sections 22 being located on the same axis.

Figure 4:
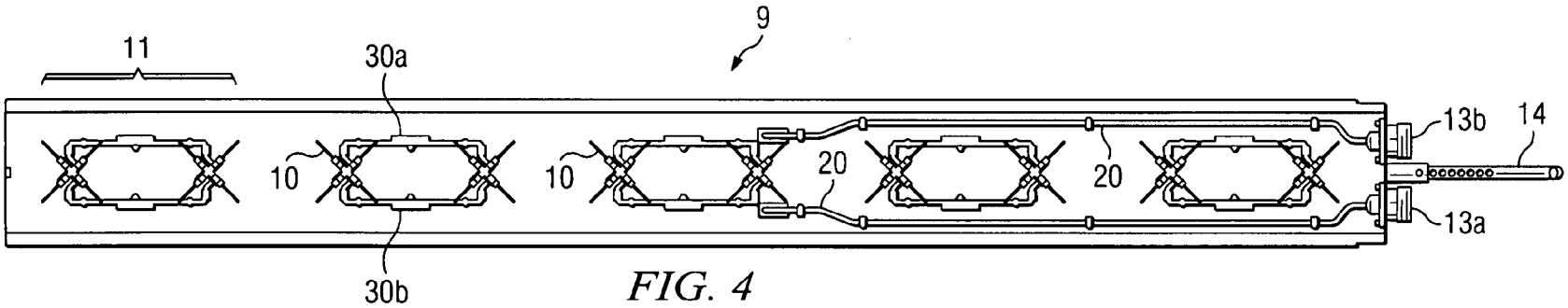
FIG. 4, 5 show an outward and side view of antenna array, respectively.
Figure 5:
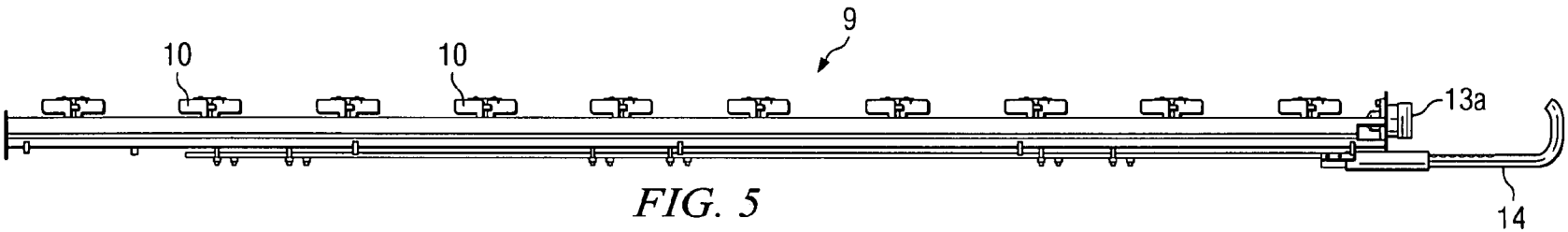
Figure 6:
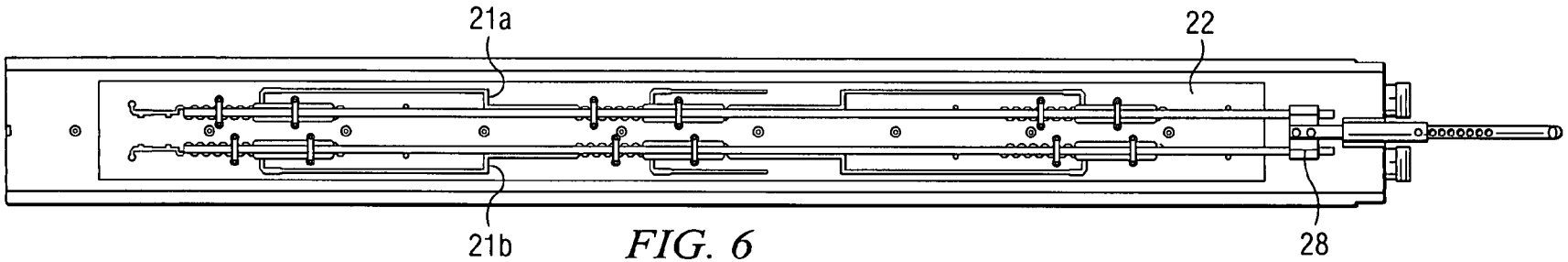
FIG. 6 is an inward view of the antenna array.
Figure 6A:
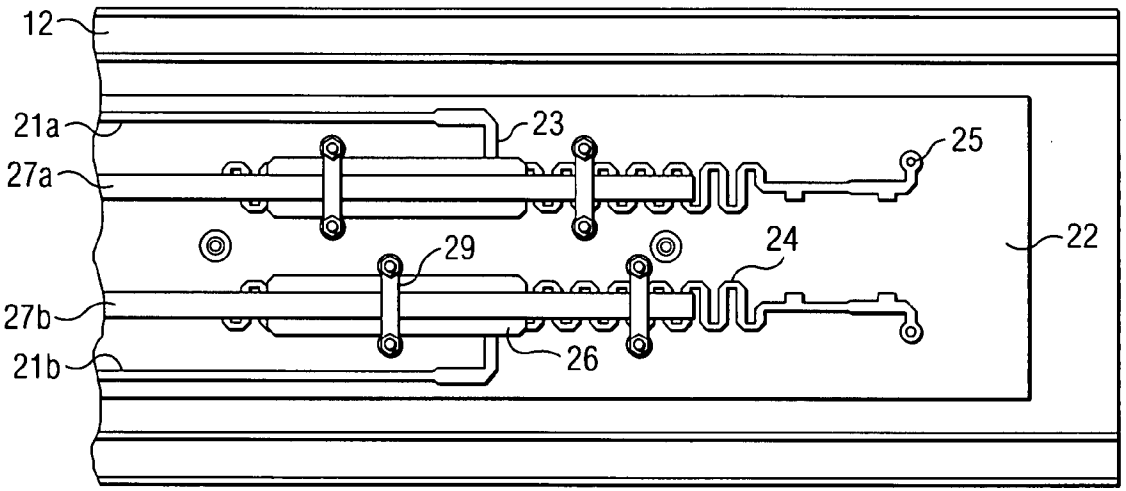
FIG. 6*a* is an increased portion of FIG. 6.
Figure 7:
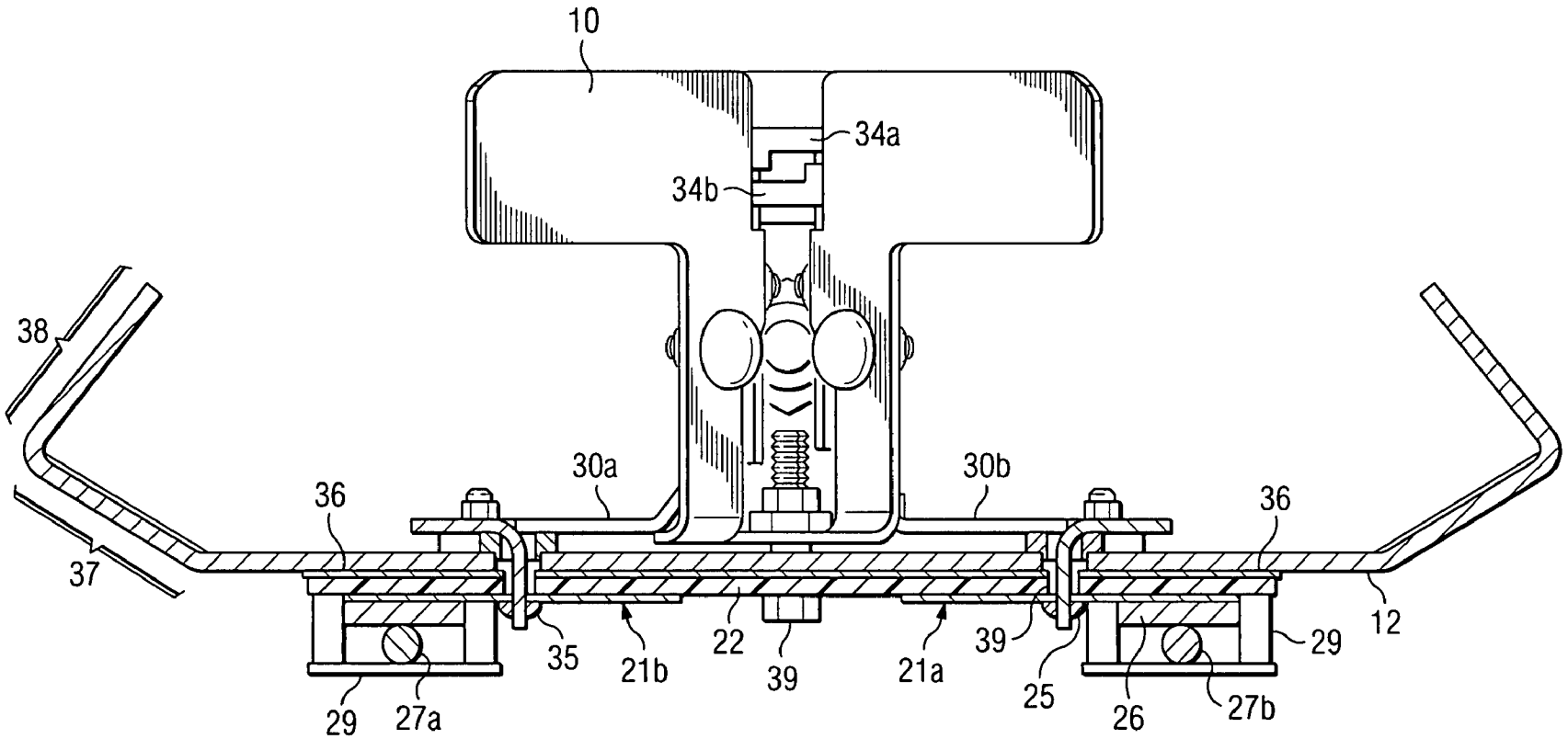
FIG. 7 is cross-section of the antenna array.

As one can see from FIGS. 4 and 7, each radiating pair 11 consists of two dipoles 10 and two airstrips 30*a* and 30*b*, attached to dipole 10 and ground plane 12 by electrically non-conductive plastic rivets 31. Each of airstrips 30*a* and 30*b* have a beak 32, transformer 33, and two balun hooks 34*a* and 34*b* made from one piece of metal. Beak 32 and transformer 33 form a T-divider, the last divider in the feed network distributing RF power between dipoles 10 in pair 11.

A more detailed discussion of the transition between each microstrip line 21 and respective radiating pair 11 will now be provided. Each beak 32*a* and 32*b* is orthogonal to the respective airstrip 30*a* and 30*b*, and extends through corresponding hole 34 in the common ground plane 12 and corresponding hole 35 in the PCB 22, and is electrically and physically coupled to the corresponding microstrip line 21*a* and 21*b* by a respective solder joint 25. For solderability, airstrips 30*a* and 30*b* are made from brass. PCB 22 is attached to ground plane 12 by double-side sticky tape 36 having a small thickness (2–5 mils). Acrylic-based tape of this thickness is commercially available, and it does not significantly affect an insertion loss of microstrip line 21*a* and 21*b*. There is no metal on the back of PCB 22 in the configuration shown in FIG. 7. Advantageously, because microstrip line 21 and airstrip 30 have a common ground, IM is significantly reduced.

In another variant of this microstrip-to-airstrip transition, to provide more stable impedance for each microstrip line 21 and avoid additional RF losses, the PCB 22 has two metal portions on its back surface, opposing each of the corresponding microstrip lines 21*a* and 21*b*, as shown in FIG. 6*b*. In this variation case, capacitive coupling is provided through tape 36 between the grounds 50 (show) of airstrip line 33 and microstrip line 21. In both cases, good IM performance is achieved.

Figure 8:
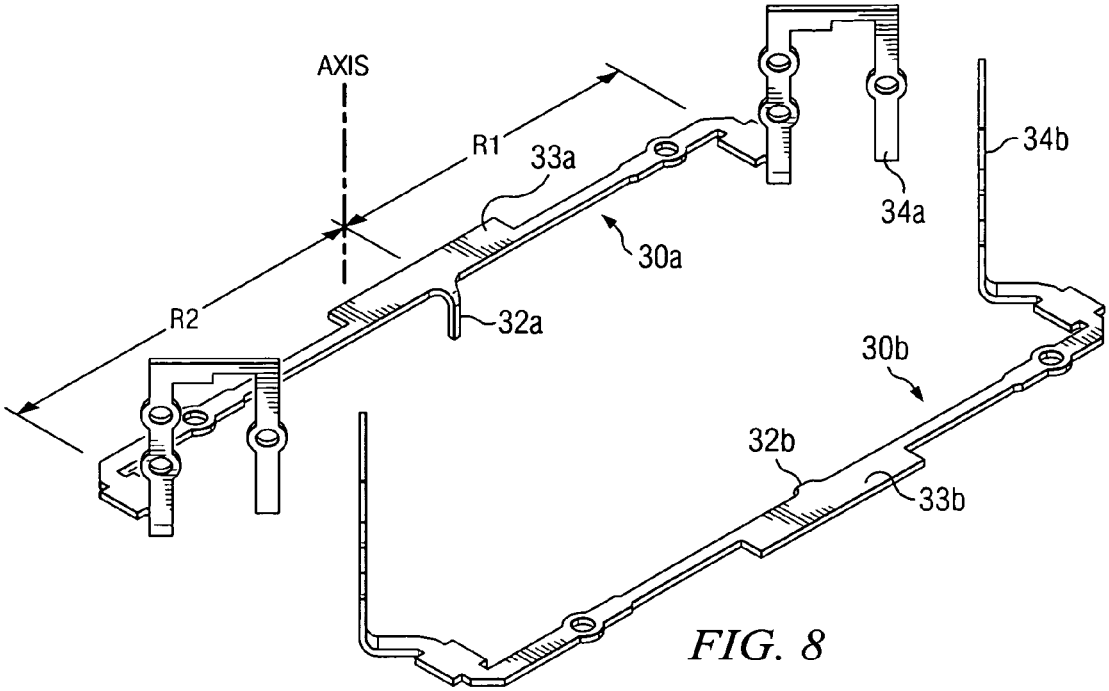
FIG. 8 is a perspective view of the left and right airstrips with hooks and beak.
Figure 9:
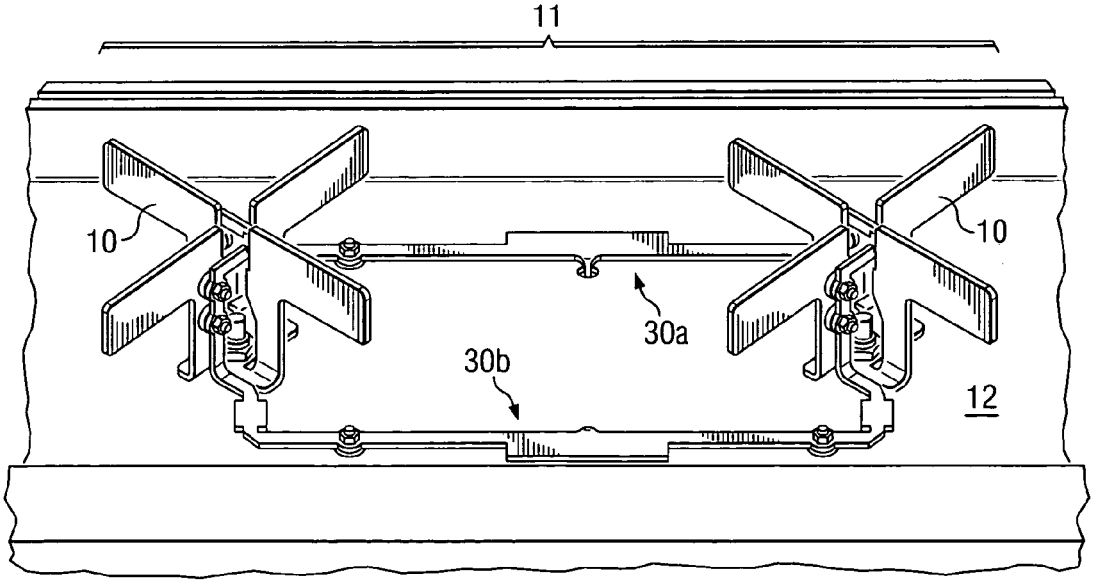
FIG. 9 is a perspective view of two dipoles with airstrips, mounted on a ground plane.

Each dipole 10 is mounted on ground plane 12 by a bolt 39. Optionally, the dipole 10 can be welded to ground plane 12. Advantageously, and in contrast with the prior art, balun hooks 34*a* and 34*b* are bonded to each corresponding dipole 10 symmetrically with respect to a vertical axis extending from ground plane 12, as shown in FIGS. 8, 9. This reduces mutual coupling between adjacent balun hooks 34*a* and 34*b*, and also provides a reduced horizontal beam squint of antenna array 1 by 3–4 times over the prior art.

Further, by controlling the phase of radiating pairs, rather than of every dipole, the number of phase shifters is reduced by about half, which reduces both the cost and diameter of antenna 1. In addition, the phase error between dipoles 10 in each pair 11 provides gain reduction $\delta G$, and also additional sidelobes with position $\beta$ and level $\mathfrak{R}$:

$$\delta G=20 \log [\lambda \sin(2\pi d \sin\theta/\lambda)/2\pi d \sin\theta], \text{ [dB]}$$

$$\sin\beta=\lambda/2d-\sin\theta$$

$$\mathfrak{R}=20 \log \{f(\beta)[\sin(2\pi d \sin\theta/\lambda)/(\pi-2\pi d \sin\theta/\lambda)]\}, \text{ [dB]};$$

where f ($\beta$) is the element pattern in direction $\beta$. As seen from these equations, with small beam tilts $\theta$, increases of sidelobe $\mathfrak{R}$ and gain loss $\delta G$ are negligible. In the case of small tilts, even three dipoles 10 can be combined by a common airstrip for further cost reduction, and the phase can be likewise changed between these three dipoles. Advantageously, decreasing of $\mathfrak{R}$ is possible by destroying the periodical character of phase error in array 9. This is done by slightly varying distance R1, R2 (see FIG. 8) from one pair 11 to another pair 11. The difference R1–R2 should be between 0 and d sin $\theta$m, where $\theta$m is maximum tilt angle.

As shown in FIG. 7, ground plane 12 has double bends on both its sides, shown at area 37 and 38. The second bend 38 allows to achieve F/B>25 dB, and further improves a cross-polarization level even with a narrow (0.5–0.8$\lambda$) ground plane. With regards to the F/B improvement, this double bend works as kind of an RF choke. Double bends 37, 38 also increase the structural strength of antenna. By varying the width of second bend 38, the horizontal beam of the antenna array 9 can be changed from 65° (small or zero bend 38) to 90° (big bend) that can be used for the cell optimization.

Advantageously, antenna array 9 can be included into a single wrap-around radome, and can be used as an independent dual polarized antenna with a very compact package.

Figure 10:
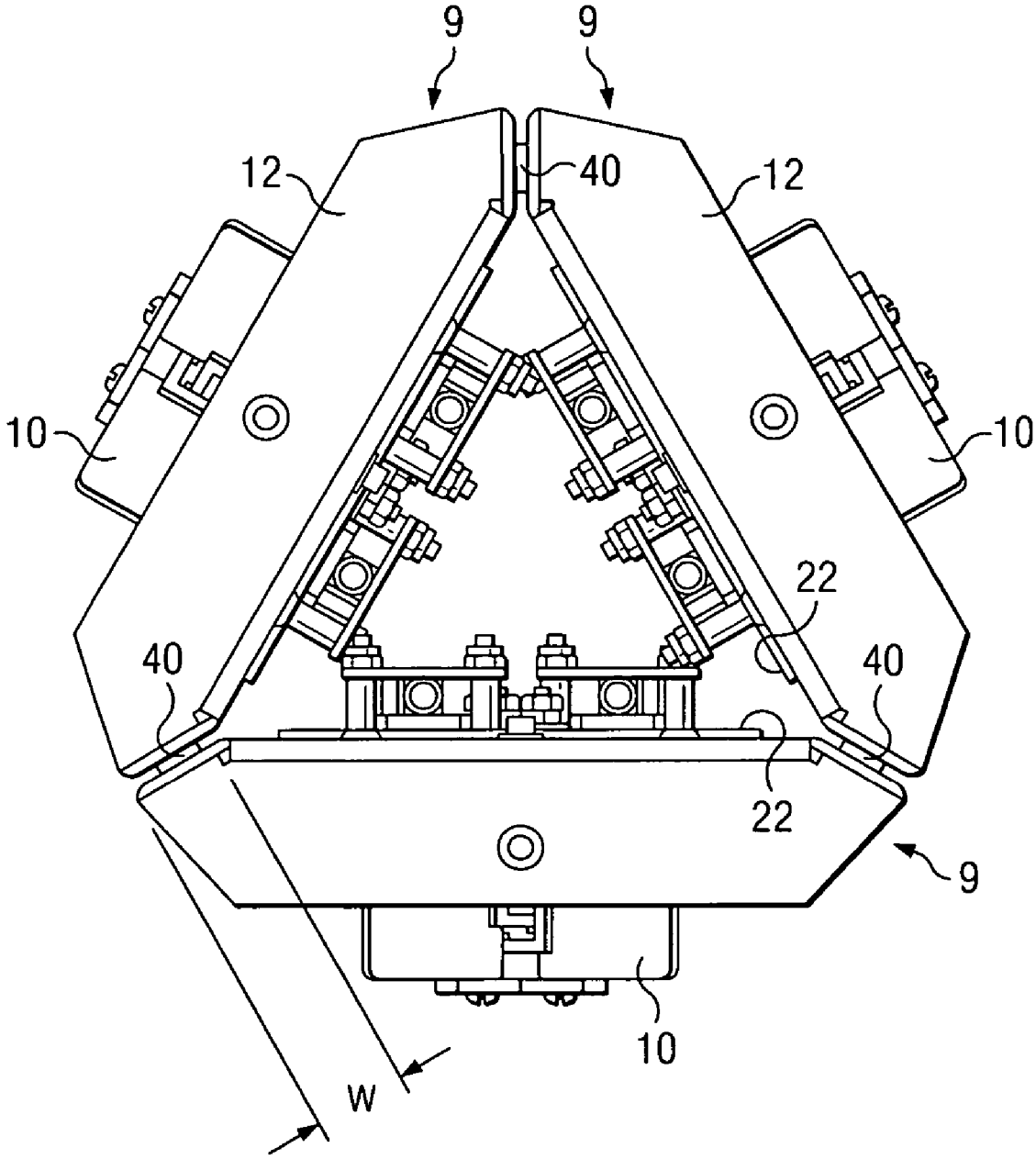
FIG. 10 is a top view of the antenna of FIG. 2(without radome) with three antenna arrays attached together.

FIG. 10 shows three antenna arrays 9 assembled together. Spacers 40 between antenna arrays 9 are used to decrease contact surface between them for better IM performance. Spacers 40 can be made from metal (with small contact area), or a dielectric material. In another embodiment, spacers 40 are formed by filling the slot between antenna arrays 9 with a dielectric (such as, FR-4 with $\epsilon$=4), and short the ground planes 12 at their ends. If the length of first bend 37 is $\lambda/4\sqrt{\epsilon}$, the result is a quarter-wave choke that improves the isolation between antenna arrays 9, and further increases F/B.

Figure 11:
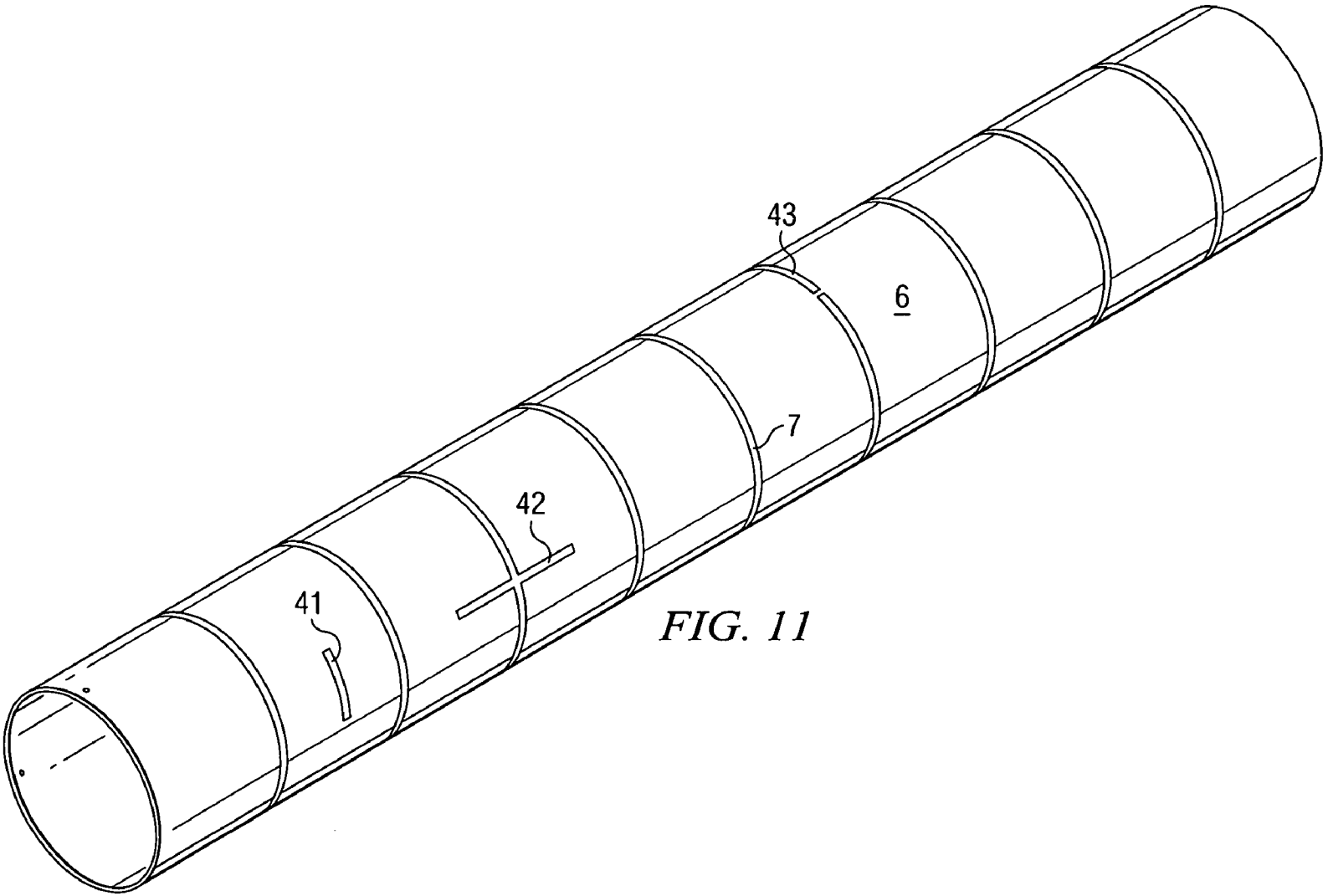
FIG. 11 is perspective view of the antenna radome.

FIG. 11 is perspective view of antenna radome 6. Radome 6 has a number spaced coaxial metal rings 7 providing isolation improvement. Radome 6 can also can have horizontal or vertical strips 41, 42, or a broken ring 43, used to fine tune isolation or cross-polarization adjustment. Elements 7, 41–43 can be made of metal tape or conductive paint, and can be covered by protective paint, decreasing at the same time their visual impact. In another application, rings 7 may be made from solid metal to increase rigidity of radome 6. In this case, radome 6 is very thin and benefits from electrical performance (less RF loss in the radome), and reduced antenna weight. In another application, radome 6 may also have wide strips parallel to its axis. These strips may be used (instead of or in addition to second bend 39) to change the beam width of antenna 1 or for it's cross-polarization optimization. Advantageously, elements 7, 41–43 do not touch any metal parts of antenna 1, which reduces risk of IM.

Figure 12:
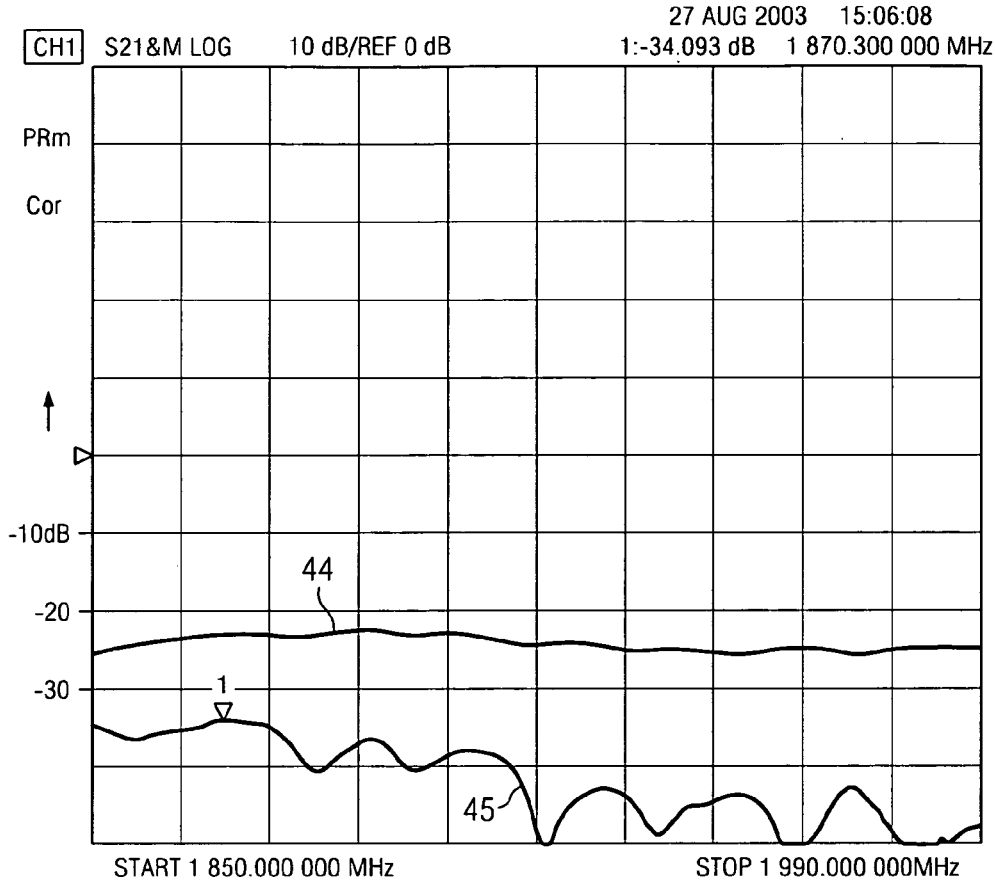
FIG. 12 is graph of the port-to-port isolation of the antenna of FIG. 2.

In FIG. 12, measured isolation plots of antenna 1 are presented: without rings 7 (plot 44) and with rings (plot 45). As seen in FIG. 12, rings 7 increase isolation by 7–10 dB, and antenna 1 meets a specification demand of 30 dB.

Figure 13:
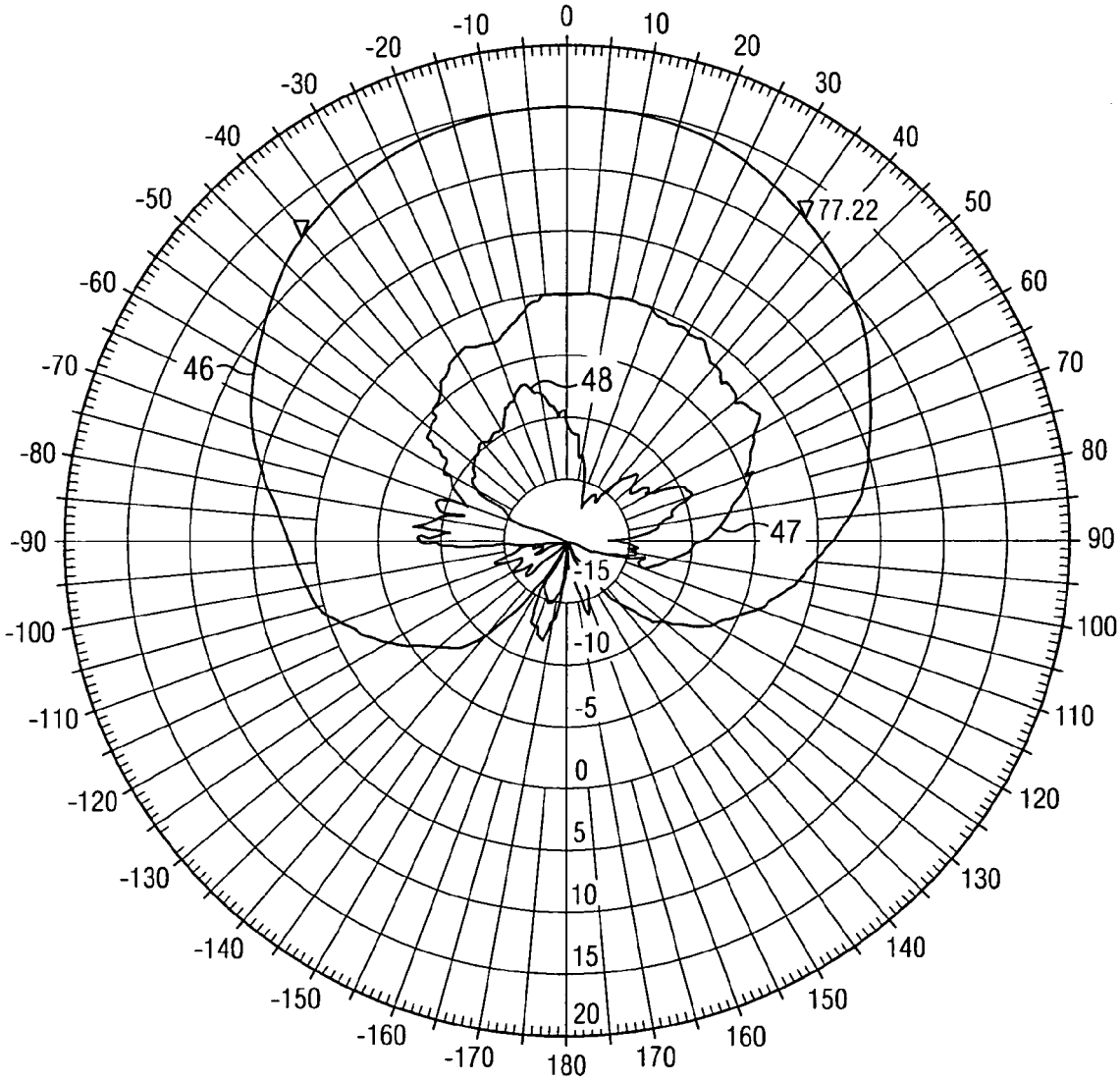
FIG. 13 is a radiation pattern of the antenna of FIG. 2 measured in a horizontal plane.

FIG. 13 shows horizontal pattern of sector of antenna 1 such at that for beam 3, 4 and 5: plot 46 is a co-pol pattern, plot 47 is a cross-pol pattern without a second bend 38, and plot 48 is a cross-pol pattern with a second bend 38. As can be seen from FIG. 13, by using second bend 38 the level of cross-polarization is reduced by 5–10 dB.

Figure 14:
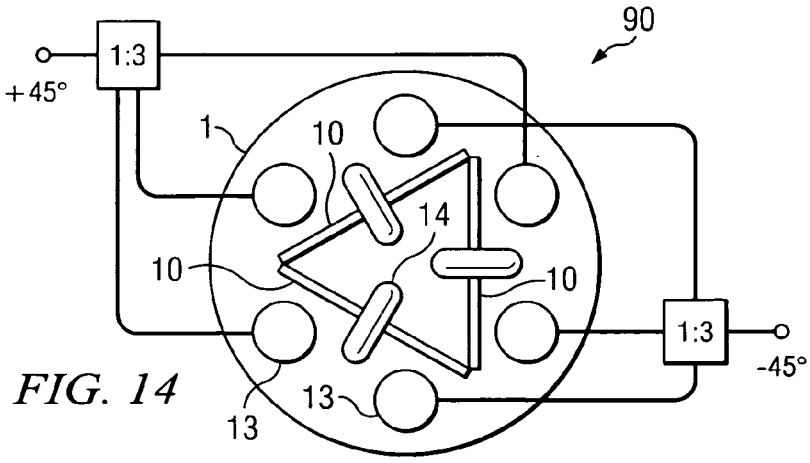
FIG. 14 is an end view of antenna 1 configured as an omindirectional antenna.

Another embodiment of three sector antenna according to the present invention is a dual pole Omnidirectional antenna with optimal sector coverage as shown at 90 in FIG. 14. The Omnidirectional radiation pattern has less ripples in comparison to conventional omnidirectional antennas having larger spacing between the centers of radiators, because the centers of radiators in the present invention are close to each other in the horizontal plane (about 0.5λ).

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. An antenna, comprising:

a ground plane having an upper surface and an opposing lower surface;

a plurality of dipoles extending outwardly from the upper surface;

a set of feedlines disposed proximate the upper surface and coupled to the dipoles;

a set of striplines disposed upon the lower surface and coupled through the ground plane to the set of feedlines, and at least one sliding dielectric member adjustably disposed proximate a portion of the set of striplines and adapted to shift a phase velocity of a signal communicating therepast to the dipoles, wherein the set of striplines have a plurality of serpentine portions each having a respective said dielectric member slidingly disposed thereupon.

2. The antenna as specified in claim 1 wherein the dipoles are configured in sets, each of the dipole sets having a single respective feedline coupled thereto.

3. The antenna as specified in claim 2 wherein the dipoles are configured in pairs of orthogonal dipoles and the set of feedlines comprise a divider.

4. The antenna array as specified in claim 2 wherein the dipoles are configured in pairs of orthogonal dipoles and the set of feedlines comprise a divider.

5. The antenna array as specified in claim 4 further comprising an electrically non-conductive member disposed between the ground plane and the set of striplines.

6. The antenna as specified in claim 1 further comprising an electrically non-conductive member disposed between the ground plane and the set of striplines.

7. The antenna as specified in claim 5 wherein the set of striplines are disposed on the electrically non-conductive member.

8. The antenna as specified in claim 6 wherein the set of feedlines are spaced above the ground plane and separated therefrom by an air dielectric.

9. The antenna as specified in claim 1 further comprising at least one cable extending across said lower surface and coupled to the set of striplines.

10. An antenna array comprised of a plurality of antennas, each antenna comprising:

a ground plane having an upper surface and an opposing lower surface, the ground plane having bent edges adapted to control a lateral beam lobe of the respective antenna;

a plurality of dipoles extending outwardly from the upper surface wherein a portion of one of the ground plane bent edge is angled inwardly toward the dipoles at an angle less than 90 degrees with respect to the ground plane and is configured to improve a front-to-back ratio of the antenna array.

11. The antenna array as specified in claim 10 wherein each said antenna is coupled to another adjacent said antenna such that the dipoles of each antenna extend outwardly, and the respective ground planes of each antenna generally face inwardly towards one another.

12. The antenna array as specified in claim 11 wherein the coupled antennas collectively form a multi-sector antenna array extending 360°.

13. The antenna array as specified in claim 12 comprising 3 of the antennas, each of the antennas covering generally a 120° sector.

14. The antenna array as specified in claim 10 further comprising a plurality of adjustment members, one said adjustment member being coupled to each of the sliding dielectric members of each of the antennas, the adjustment members adapted to adjust a beamtilt of the respective antenna.

15. The antenna array as specified in claim 10 wherein the ground plane edges each have at least 2 bends.

16. The antenna array as specified in claim 10 wherein the antennas are physically coupled to one another along their respective bent edges, but are electrically isolated from one another by an electrically non-conductive member.

17. The antenna array as specified in claim 10 wherein the dipoles are configured in sets, each of the dipole sets having a single respective feedline coupled thereto.

18. The antenna as specified in claim 10 further comprising at least one cable extending across said lower surface and coupled to the set of striplines.

19. The antenna as specified in claim 10 further comprising a radome encompassing the antenna, the radome comprised of an electrically non-conductive material having at least one metal portion thereon.

20. The antenna as specified in claim 19 wherein the metal portion is a electrically conductive paint.

21. The antenna as specified in claim 10 wherein the antenna array is configured as an omnidirectional antenna.

22. An antenna array as specified claim 10 wherein the ground plane bent edge has a first portion angled away from the dipoles, and a second portion angled towards the dipoles.

23. An antenna array as specified in claim 22 wherein the first portion angles upwardly with respect to the ground plane, and the second portion angles upwardly with respect to the first portion.

24. An antenna, comprising:

a ground plane having an upper surface and an opposing lower surface;

a plurality of dipoles extending outwardly from the upper surface;

a set of feedlines disposed proximate the upper surface and coupled to the dipoles;

a set of striplines disposed upon the lower surface and coupled through the ground plane to the set of feedlines; and at least one sliding dielectric member adjustably disposed proximate a portion of the set of striplines and adapted to shift a phase velocity of a signal communicating therepast to the dipoles;

an electrically non-conductive member disposed between the ground plane and the set of striplines; and a second ground plane disposed on the electrically non-conductive member and opposing the set of striplines.

25. An antenna array comprised of a plurality of antennas, each antenna comprising:

a ground plane having an upper surface and an opposing lower surface;

a plurality of dipoles extending outwardly from the upper surface;

a set of feedlines disposed proximate the upper surface and coupled to the dipoles; a set of striplines disposed upon the lower surface and coupled through the ground plane to the set of feedlines, and at least one sliding dielectric member adjustably disposed proximate a portion of the set of striplines and adapted to shift a phase velocity of a signal communicating therepast to the dipoles, wherein the set of striplines have a plurality of serpentine portions each having a respective said dielectric member slidingly disposed thereupon.

26. An antenna array comprised of a plurality of antennas, each antenna comprising:

a ground plane having an upper surface and an opposing lower surface;

a plurality of dipoles extending outwardly from the upper surface;

a set of feedlines disposed proximate the upper surface and coupled to the dipoles;

a set of striplines disposed upon the lower surface and coupled through the ground plane to the set of feedlines, wherein the set of striplines are disposed on the electrically non-conductive member;

at least one sliding dielectric member adjustably disposed proximate a portion of the set of striplines and adapted to shift a phase velocity of a signal communicating therepast to the dipoles; and a second ground plane disposed on the electrically non-conductive member and opposing the set of striplines.

27. The antenna array as specified in claim 26 wherein the set of feedlines are spaced above the ground plane and separated therefrom by an air dielectric.

* * * * *